United States Patent [19]

Fujishiro et al.

[11] 4,131,089

[45] Dec. 26, 1978

[54] ELECTRONIC CLOSED LOOP AIR-FUEL RATIO CONTROL SYSTEM

[75] Inventors: Takeshi Fujishiro, Yokohama; Shigeo Aono, Seki; Akio Hosaka, Yokohama; Masaharu Asano, Yokosuka; Nobuzi Manaka, Yokosuka; Mituhiko Ezoe, Yokosuka, all of Japan

[73] Assignee: Nissan Motor Company, Ltd., Japan

[21] Appl. No.: 767,134

[22] Filed: Feb. 9, 1977

[30] Foreign Application Priority Data

Feb. 9, 1976 [JP] Japan ..... 51-12242

[51] Int. Cl.[2] ..... F02B 3/08; F02M 7/12; F01N 3/08

[52] U.S. Cl. ..... 123/32 EE; 123/119 EC; 60/276; 60/285

[58] Field of Search ..... 123/32 EE, 32 EK, 32 EA, 123/119 EC; 60/276, 285

[56] References Cited

U.S. PATENT DOCUMENTS

| | | | |
|---|---|---|---|
| 3,815,561 | 6/1974 | Seitz | 60/276 |
| 3,834,361 | 9/1974 | Keely | 123/32 EA |
| 3,938,479 | 2/1976 | Oberstadt | 123/32 EE |
| 3,939,654 | 2/1976 | Creps | 60/285 |
| 4,015,566 | 4/1977 | Wahl | 60/285 |
| 4,019,474 | 4/1977 | Nishimiya et al. | 123/32 EE |
| 4,027,637 | 6/1977 | Aono | 60/285 |
| 4,030,462 | 6/1977 | Sassayama et al. | 123/32 EE |

FOREIGN PATENT DOCUMENTS

| | | | |
|---|---|---|---|
| 4742407 | 10/1972 | Japan | 123/32 EA |

*Primary Examiner*—Charles J. Myhre
*Assistant Examiner*—P. S. Lall

[57] ABSTRACT

A reference voltage, which is compared with an output voltage of an exhaust gas sensor in a differential signal generator of an electronic closed loop air-fuel ratio control system, changes depending upon a mean value of an output of the exhaust gas sensor provided in an exhaust pipe extending from an internal combustion engine. Furthermore, the magnitude of the reference voltage is limited in such a manner as to be within a predetermined range, or in other words, the magnitude of the reference voltage is limited at at least one of an upper and a lower values thereof.

9 Claims, 7 Drawing Figures

ELECTRONIC CLOSED LOOP AIR-FUEL RATIO CONTROL SYSTEM

BACKGROUND OF THE INVENTION

The present invention relates generally to an electronic closed loop air-fuel ratio control system for use with an internal combustion engine, and particularly to an improvement in such a system for optimally controlling an air-fuel mixture fed to the engine by limiting the magnitude of a reference signal within a predetermined range, the reference signal being compared with an output voltage of an exhaust gas sensor in a differential signal generator.

Various systems have been proposed to supply an optimal air-fuel mixture to an internal combustion engine in accordance with the mode of engine operation, one of which is to utilize the concept of an electronic closed loop control system based on a sensed concentration of a component in exhaust gases of the engine.

According to the conventional system, an exhaust gas sensor, such as an oxygen analyzer, is deposited in an exhaust pipe for sensing a component of exhaust gases from an internal combustion engine, generating an electrical signal representative of the sensed component. A differential signal generator is connected to the sensor for generating an electrical signal representative of a differential between the signal from the sensor and a reference signal. The reference signal is previously determined in due consideration of, for example, an optimum ratio of an air-fuel mixture to the engine for maximizing the efficiency of both the engine and an exhaust gas refining means. A so-called proportional-integral (p-i) controller is connected to the differential signal generator, receiving the signal therefrom. A pulse generator is connected to the p-i controller, receiving a signal therefrom and generating, based on the received signal, a train of pulses which is fed to an air-fuel ratio regulating means, such as electromagnetic valves, for supplying an air-fuel mixture with an optimum air-fuel ratio to the engine.

In the previously described control system, a problem has been encountered that the exhaust gas sensor generates a signal whose magnitude changes undesirably with change of atmospheric temperature, and with decrease of its efficiency due to a lapse of time. This change of the magnitude makes difficult a precise control of the air-fuel mixture ratio. In order to remove this defect, in accordance with the prior art, the magnitude of the reference signal has been changed depending upon change of a means value of the magnitude of the signal from the exhaust gas sensor.

However, in spite of this improvement, another problem has been encountered. That is, when for example, the output of the exhaust gas sensor decreases or increases due to certain causes to a considerable extent, the magnitude of the reference signal, resultantly, decreases or increases considerably. Therefore, the air-fuel mixture ratio cannot be precisely controlled for a certain period of time in that a transient time of a circuit determining the mean value cannot be neglected.

SUMMARY OF THE INVENTION

It is therefore an object of the present invention to provide an improved electronic closed loop control system for removing the above described inherent defects of the prior art.

BRIEF DESCRIPTION OF THE DRAWINGS

Another object of the present invention is to provide an improved electronic closed loop air-fuel ratio control system which includes a limiter for limiting the magnitude of a reference signal within a predetermined range.

These and other objects, features and many of the attendant advantages of the invention will be appreciated more readily as the invention becomes better understood by the following detailed description, wherein like parts in each of the several figures are identified by the same reference characters, and wherein.

DETAILED DESCRIPTION

Figure 1:
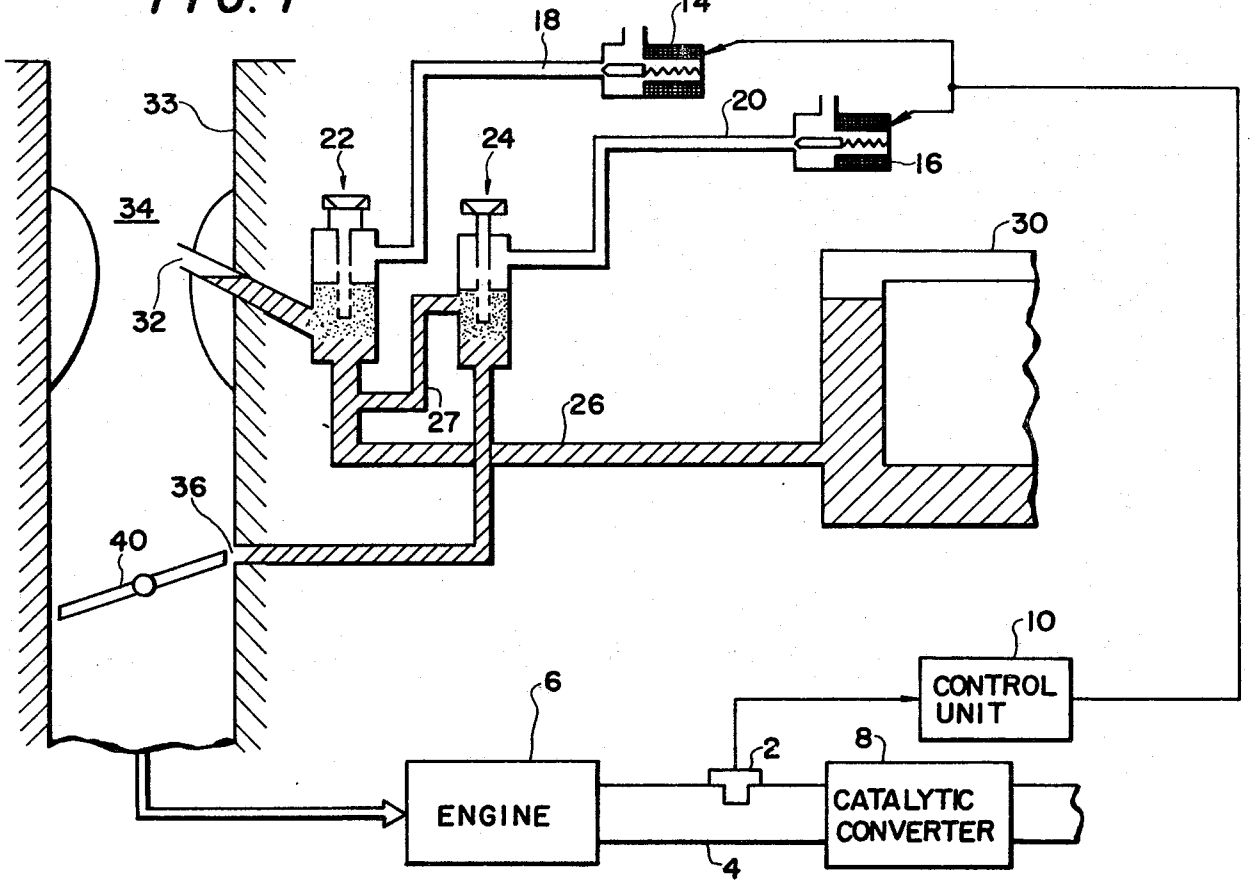
FIG. 1 schematically illustrates a conventional electronic closed loop air-fuel ratio control system for regulating the air-fuel ratio of the air-fuel mixture fed to an internal combustion engine.

Reference is now made to drawings, first to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion engine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component in exhaust gases. An electrical signal from the exhaust gas sensor 2 is fed to a control unit 10, in which the signal is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the optimum air-fuel ratio. The command signal is employed to drive two electromagnetic valves 14 and 16. The control unit 10 will be described in more detail in conjunction with FIG. 2.

The electromagnetic valve 14 is provided in an air passage 18, which terminates at one end thereof at an air bleed chamber 22, to control a rate of air flowing into the air bleed chamber 22 in response to the command pulses from the control unit 10. The air bleed chamber 22 is connected to a fuel passage 26 for mixing air with fuel delivered from a float bowl 30, supplying the air-fuel mixture to a venturi 34 through a discharging (or main) nozzle 32. Whilst, the other electromagnetic valve 16 is provided in another air passage 20, which terminates at one end thereof at another air bleed chamber 24, to control a rate of air flowing into the air bleed chamber 24 in response to the command pulses from the control unit 10. The air bleed chamber 24 is connected to the fuel passage 26 through a fuel branch passage 27 for mixing air with fuel from the float bowl 30, supplying the air-fuel mixture to an intake passage 33 through a slow nozzle 36 adjacent to a throttle 40. If the catalytic converter 8 is of a three-way catalysis type which is capable of simultaneous oxidation of carbon monoxide and hydrocarbons and reduction of nitrogen oxides when the air-fuel ratio within the exhaust pipe is maintained within a narrow range near stoichiometry. In this case, the control circuit 10 processes the signal from the gas sensor 2 to control the air-fuel ratio of the mixture entering the catalytic converter 8 to within the near stoichiometric range. It is apparent, on the other hand, that, when other catalytic converters such as an oxidizing or deoxidizing type are employed, the control circuit 10 will be designed to control the air-fuel ratio at a point other than the near stoichiometric point.

Figure 2:
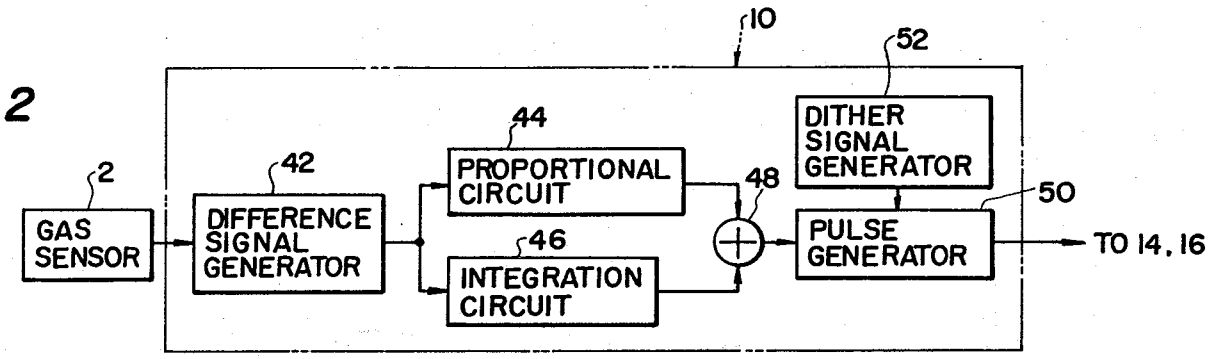
FIG. 2 is a detailed block diagram of an element of the system of FIG. 1.

Reference is now made to FIG. 2, in which somewhat detailed arrangement of the control unit 10 is schematically exemplified. The signal from the exhaust gas sensor 2 is fed to a difference detecting circuit 42 of the control unit 10, which circuit compares the incoming signal with a reference one to generate a signal representing a difference therebetween. The signal from the difference detecting circuit 42 is then fed to two circuits, viz., a proportional circuit 44 and an integration circuit 46. The purpose of the provision of the proportional and the integration circuits 44 and 46 is, as is well known to those skilled in the art, to increase both a response characteristic and stability of the system. The signals from the circuits 44 and 46 are then fed to an adder 48 in which the two signals are added. The signal from the adder 48 is then applied to a pulse generator 50 to which a dither signal is also fed from a dither signal generator 52. The pulse generator 50 compares the signals from the adder 48 and the generator 52 generating a command signal based on the signal from the adder 48. The command signal, which is in the form of pulses, is fed to the valves 14 and 16, thereby to control the "on" and "off" operation thereof.

In FIGS. 1 and 2, the electronic closed loop air-fuel ratio control system is illustrated together with a carburetor, however, it should be noted that the system is also applicable to a fuel injection device.

Figure 3:
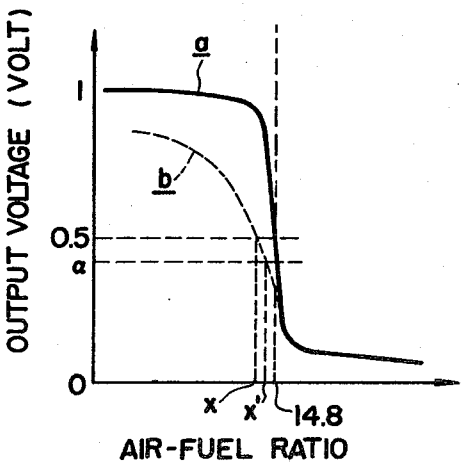
FIG. 3 is a graph showing an output voltage of an exhaust gas sensor as a function of an air-fuel ratio.

Reference is now made to FIG. 3, which is a graph showing an output voltage of an $O_2$ sensor as a function of an air-fuel ratio by way of example. In FIG. 3, an air-fuel ratio 14.8 on an abscissa means a stoichiometry, and a solid line a denotes an output characteristic when the $O_2$ sensor functions properly, and, on the other hand, a broken line b denotes an output characteristic when the function of the $O_2$ sensor lowers with a lapse of time.

Therefore, it is understood that, in order to set an air-fuel ratio to 14.8 while the $O_2$ sensor functions properly, the aforesaid reference voltage should be set to 0.5 volt. Whilst, in the case where the function of the $O_2$ sensor lowers, for example, with a lapse of time, if the reference voltage remains 0.5 volt, the air-fuel ratio becomes less than the stoichiometry as shown by reference character "x", resulting in the fact that an optimal air-fuel ratio control is no longer attained.

The above described defect, which results from the fixed reference voltage, also occurs upon cold engine start. This is because the internal impedance of the $O_2$ sensor is considerably high at a low temperature so that the output voltage of the $O_2$ sensor becomes low resultantly.

In order to remove the inherent defect of the prior art, a method has been proposed which changes the magnitude of the reference voltage depending upon a change of a mean value of the sensor's output. In accordance with this method, when the output of the $O_2$ sensor becomes low as shown by the broken line, the reference voltage is lowered to, for example, "$\alpha$", so that the air-fuel ratio is shifted more nearer to the stoichiometry as shown by "x'" compared with the first mentioned case.

However, in spite of this improvement, there are encountered some defects therein. That is, if the output of the sensor 3 falls or rises considerably due to a low temperature or other reasons, then, the reference voltage resultantly falls or rises to a considerable extent. In the above, once the output of the sensor 3 falls or rises considerably, even if returning to a normal state thereafter, a rich or a lean air-fuel mixture ratio remains undesirably during a certain period of time. This is because a transient time of a circuit producing the mean value of the sensor 3 cannot be neglected.

The present invention, therefore, contemplates removing the above mentioned shortcomings inherent in the prior art by limiting the reference voltage within a predetermined range.

Figure 4:
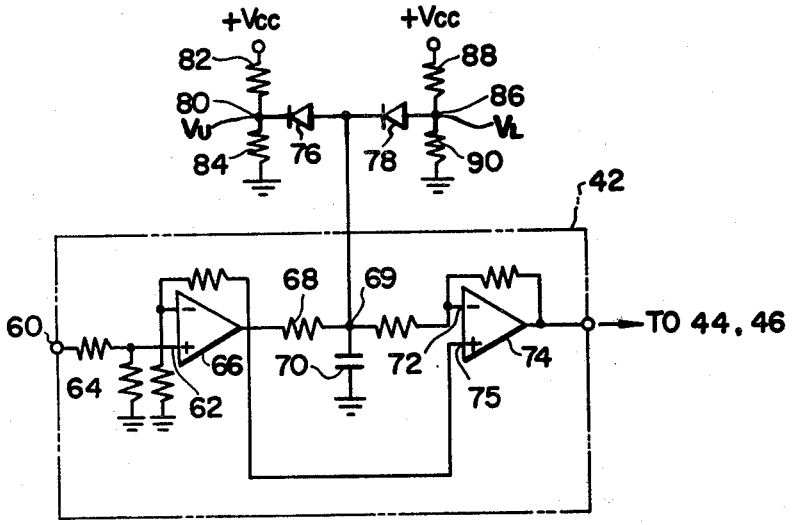
FIG. 4 is a first preferred embodiment of the present invention.

Reference is now made to FIG. 4, which illustrates a first embodiment of the present invention. The signal from the exhaust gas sensor 3 is applied to the differential signal generator 42, more specifically, to a noninverting terminal 62 of an amplifier 66 through a terminal 60 and a resistor 64, being amplified therein by a preset gain. The output of the amplifier 66 is then fed to an integrator consisting of a resistor 68 and a capacitor 70. A junction 69 between the resistor 68 and a capacitor 70 is coupled to an inverting terminal 72 of a differential amplifier 74. A non-inverting terminal 75 is directly coupled to the output terminal (no numeral) of the amplifier 66. The differential amplifier 74 produces an output indicative of a difference between the magnitudes of two signals received. It is understood that the reference voltage, which corresponds to a voltage appearing at the junction 69, changes depending upon the magnitude of the output of the exhaust gas sensor 3. Therefore, output change of the sensor 3, which results from the aforementioned reasons, can be compensated.

As shown, the junction 69 is coupled to the anode of a diode 76 and the cathode of a diode 78. The cathode of the diode 76 is coupled to a junction 80 between resistors 82 and 84, receiving a constant voltage $V_U$ which determines an upper critical value of the reference voltage. On the other hand, the anode of the diode 78 is coupled to a junction 86 between resistors 88 and 90, receiving a constant voltage $V_L$ which in turn determines a lower critical value of the reference voltage. Thus, the reference voltage appearing at the junction 69 is controlled within a predetermined range defined by the two constant voltages $V_U$ and $V_L$.

Figure 5:
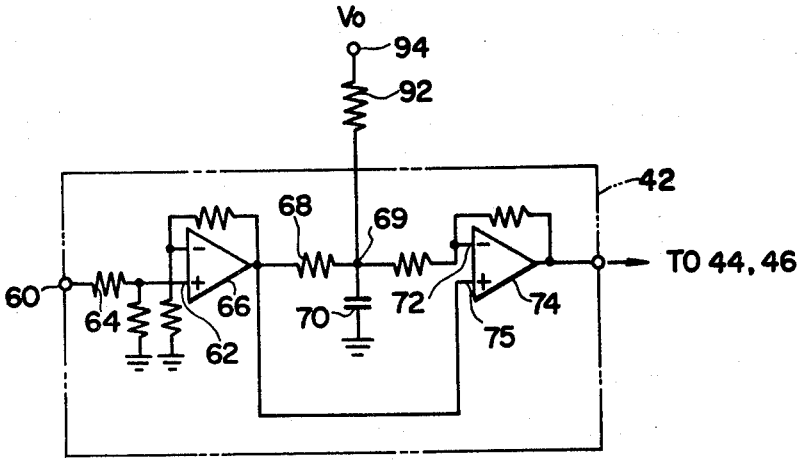
FIG. 5 is a second preferred embodiment of the present invention.

In FIG. 5, there is shown a second preferred embodiment of the present invention. The differential signal generator 42 has been described so that further illustration will be omitted for brevity. The junction 69 is coupled to a constant d.c. voltage ($V_O$) supply (not shown) through a resistor 92 and a terminal 94. According to the second preferred embodiment, the reference voltage at the junction 69 is limited within a predetermined range as discussed below.

Assuming that the output voltage of the amplifier 66 is E, and that the voltage at the junction 69 is $V_{69}$, then we obtain $$\frac{E - V_{69}}{R_{68}} + \frac{V_O - V_{69}}{R_{92}} = j\omega C_{70} V_{69} \therefore \quad (1)$$

$$V_{69} = \frac{1}{\frac{R_{68} + R_{92}}{R_{68}R_{92}} + j\omega C_{70}} \left( \frac{E}{R_{68}} + \frac{V_O}{R_{92}} \right)$$

where $R_{68}$: resistance of the resistor 68

$R_{92}$: resistance of the resistor 92

$C_{70}$: capacitance of the capacitor 70

In the above, if a frequency becomes zero, then $j\omega \rightarrow 0$. Therefore, the equation (1) becomes $$V_{69} = \frac{R_{68}R_{92}}{R_{68} + R_{92}} \left( \frac{E}{R_{68}} + \frac{V_O}{R_{92}} \right) \quad (2)$$

In the equation (2), assuming $E = 0$ gives $$V_{69} = \frac{R_{68}}{R_{68} + R_{92}} V_O$$

Furthermore, in the equation (2), assuming $E = 2V_O$ gives $$V_{69} = \frac{R_{68} + 2R_{92}}{R_{68} + R_{92}} V_O$$

As a result, assuming that the maximum value of E is $E_M$ and the minimum value of E is 0 and $$V_0 = \frac{1}{2} E_M,$$

then, the following is obtained $$0 < \frac{R_{68}}{R_{68} + R_{92}} V_O \leqq V_{69} \leqq \frac{R_{68} + 2R_{92}}{R_{68} + R_{92}} V_O < 2V_O = E_M$$

It is apparent from the above that the reference voltage, viz., $V_{69}$ is limited within a predetermined range.

Figure 6:
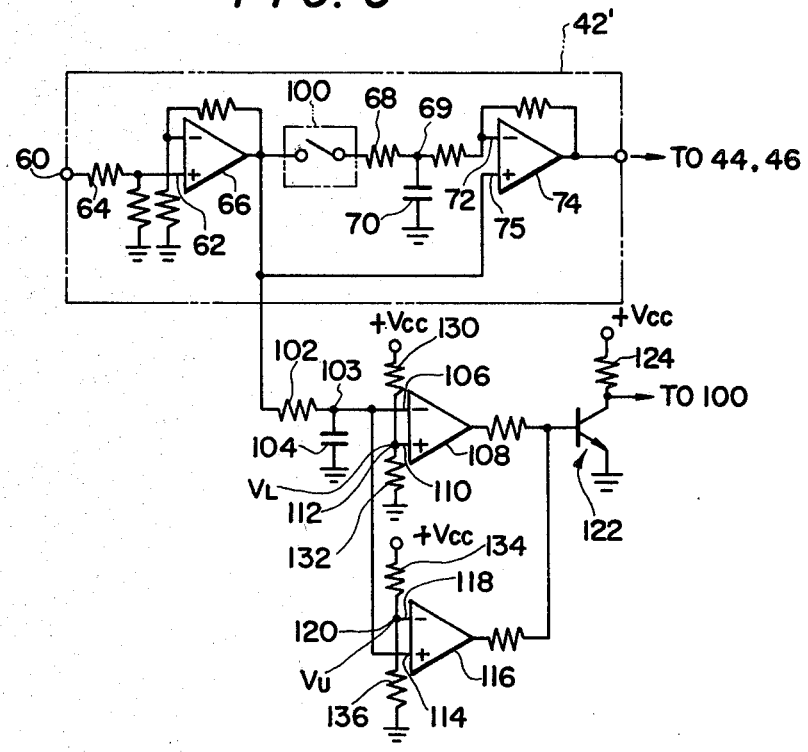
FIG. 6 is a third preferred embodiment of the present invention.

Reference is now made to FIG. 6, which illustrates a third preferred embodiment of the present invention. As shown, a differential signal generator 42' is the same as the generator 42 except for a switch 100 provided between the amplifier 66 and the resistor 68. The output terminal (no numeral) of the amplifier 66 is coupled to an integrator which consists of a resistor 102 and a capacitor 104 and which is analogous to the integrator of the generator 42'. A junction 103 between the resistor 102 and the capacitor 104 is coupled to an inverting terminal 106 of a comparator 108. A non-inverting terminal 110 of the comparator 108 is coupled to a junction 112 of a voltage divider consisting of resistors 130 and 132, receiving a constant voltage $V_L$ which determines a lower critical level of the reference voltage appearing at the junction 69. On the other hand, the junction 103 is coupled to a non-inverting terminal 114 of another comparator 116. An inverting terminal 118 of the comparator 116 is coupled to a junction 120 of a voltage divider consisting of resistors 134 and 136, receiving a constant voltage $V_U$ which determines an upper critical level of the reference voltage appearing at the junction 69. Both the comparators 108 and 116 are coupled to the base of a transistor 122 through suitable resistors (no numeral), respectively. The collector of the transistor 122 is coupled to a suitable d.c. voltage supply (not shown) through a resistor 124, whilst, the emitter thereof to ground. It is apparent that the transistor 122, which is of NPN type, can be replaced by a transistor of PNP type. The voltage change at the collector is used for opening or closing the switch 100 of the differential signal generator 42', which will be discussed in detail below.

In operation, when the voltage at the junction 103 falls below the lower critical level $V_L$, the comparator 108 produces a signal indicating a logic "1". This logic "1" renders the transistor 122 conductive, thereby to lower the collector voltage. This voltage drop causes the switch 100 to open. This means that the integrator, which consists of the resistor 68 and the capacitor 70, receives no longer the output of the amplifier 66 so that the voltage at the junction 69 does not decrease once the switch 100 opens. On the other hand, when the voltage at the junction 103 rises above the upper critical level $V_U$, the comparator 116 produces a signal indicating a logic "1". This logic "1" renders the transistor 122 conductive, thereby to lower the collector voltage. This voltage drop causes the switch 100 to open. This means that the integrator, which consists of the resistor 68 and the capacitor 70, receives no longer the output of the amplifier 66 so that the voltage at the junction 69 does not increase once the switch 100 opens.

It is understood that the reference voltage appearing at the junction 69 is limited within a range from the voltage $V_L$ to $V_U$.

Figure 7:
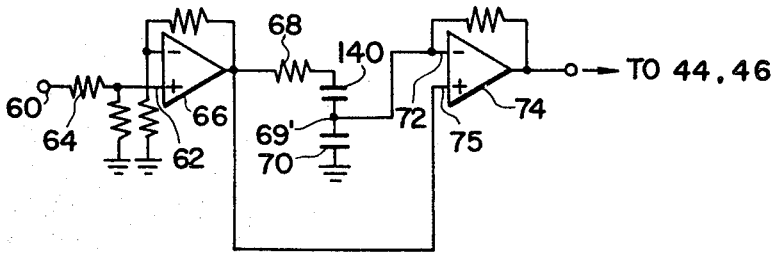
FIG. 7 is a fourth preferred embodiment of the present invention.

Reference is now made to FIG. 7, which illustrates schematically a fourth preferred embodiment of the present invention. A difference between the differential signal generator 42 and the preferred embodiment in question is that the latter includes a capacitor 140 between the resistor 68 and the junction 69' so as to avoid an undesirable condition when an abnormally high voltage is produced from the exhaust gas sensor 3, or in other words, from the amplifier 66. More specifically, the reference voltage, which corresponds to a voltage at the junction 69', is divided by the two capacitors 140 and 70, so that the reference voltage does not undesirably rise even if an abnormally high input is applied, during a relatively long period of time, to the integrator consisting of the resistor 68 and the capacitors 103 and 70.

In the first, the second, and the third preferred embodiments, the reference voltage is limited or clipped at both upper and lower levels.

It is understood from the foregoing that, in accordance with the present invention, the air-fuel mixture ratio can be optimally controlled by limiting the reference voltage within a predetermined range.

What is claimed is:

1. A closed loop mixture control system for an internal combustion engine including means for supplying air and fuel thereto in a variable ratio and an exhaust composition sensor for generating a first signal representative of the concentration of an exhaust composition of the emissions from said engine, said first signal varying within a range between high and low voltage levels depending upon whether the sensed concentration is above or below a predetermined value, comprising:

mean-value detecting means for generating a second signal representative of a mean voltage value of said first signal so that said second signal varies within a range narrower than the range of said high and low voltage levels so long as said first signal is continuously varying;

differential amplifier means for generating a third signal representative of the difference in magnitude between said first signal and said second signal to represent the deviation of the air-fuel ratio of the emissions from a desired air-fuel ratio for adjusting said air-fuel suppying means with the represented deviation; and limiting means for limiting the magnitude of said second signal at one of upper and lower predetermined threshold levels.

2. A closed loop mixture control system as claimed in claim 1, wherein said limiting means comprises means for setting a first voltage level lower than said high voltage level to maintain the magnitude of said second signal at said first voltage level when said first signal remains at said high voltage level for an extended period of time and setting a second voltage level higher than said low voltage level to maintain the magnitude of said second signal at said second voltage level when said first signal remains at said low voltage level for an extended period of time.

3. A closed loop mixture control system as claimed in claim 2, wherein said mean-value detecting means comprises an RC filter circuit connected to be responsive to said first signal for developing a voltage across the capacitor of said RC filter circuit to represent said second signal.

4. A closed loop mixture control system as claimed in claim 3, wherein said limiting means comprises a first diode connecting the capacitor of said RC filter circuit to a first source of voltage representing said first voltage level, the polarity of said diode being such that the easy direction of conductivity is to discharge said capacitor when the voltage thereacross exceeds said first voltage level, and a second diode connecting said capacitor to a second source of voltage representing said second voltage level, the polarity of said second diode being such that the easy direction of conductivity is to charge said capacitor when the voltage thereacross falls below said second voltage level.

5. A closed loop mixture control system as claimed in claim 1, wherein said mean-value detecting means comprises an RC filter circuit connected to be responsive to said first signal for developing a voltage across the capacitor of said RC filter circuit to represent said second signal, and said limiting means comprises a second resistor connected between the junction between the capacitor and resistor of said RC filter circuit and a DC voltage source, the junction between the capacitor and resistor of said RC filter circuit being connected to said differential amplifier means for comparison with said first signal.

6. A closed loop mixture control system as claimed in claim 1, wherein said limiting means comprises second mean-value detecting means for generating a fourth signal representative of a mean-valued voltage of said first signal, a first comparator for generating an output when said fourth signal is above said first voltage level, a second comparator for generating an output when said fourth signal is below said second voltage level, and switching means for normally establishing a path between said exhaust composition sensor and the first-mentioned mean-value detecting means and disconnecting said path in response to the outputs from said first and second comparators.

7. A closed loop mixture control system as claimed in claim 1, wherein said mean-value detecting means comprises a resistor, a first and a second capacitor all of which are connected in series between said exhaust composition sensor and ground, the junction between said first and second capacitors being connected to said differential amplifier means.

8. An electronic closed loop air-fuel ratio control system for supplying an optimum air-fuel mixture to an internal combustion engine, which system comprises in combination:

an air-fuel mixture supply assembly;

an exhaust pipe;

an exhaust gas sensor provided in the exhaust pipe for sensing a concentration of a component in exhaust gases, generating a signal representative of said concentration;

a differential signal generator connected to the exhaust gas sensor and receiving the signal from the sensor for generating a signal representative of a difference between magnitudes of the signal from the exhaust gas sensor and a reference signal, the reference signal changing in its magnitude in such a manner as to be substantially equal to a mean-value of the magnitude of the signal from the exhaust gas sensor;

a control signal generator connected to the differential signal generator and receiving the signal from the differential signal generator for generating a control signal based on the received signal;

an actuator provided in the air-fuel mixture supply assembly, connected to the control signal generator, receiving and responsive to the control signal to control the air-fuel ratio of an air-fuel mixture fed to the engine, and a limiter connected to the differential signal generator for limiting at least one of an upper and a lower value of the reference signal;

wherein the differential signal generator comprises:

a first amplifier provided with an input and an output terminal, being connected at the input terminal to the exhaust gas sensor;

an integrator connected to the output terminal of the first amplifier and receiving a signal from the first amplifier to integrate the same, the integrated signal being used as the reference signal, said integrator also being connected to the limiter which limits at least one of the upper and the lower values of the reference signal; and a differential amplifier provided with an inverting and a non-inverting input terminal, being connected to the integrator at one of the input terminals of said differential amplifier and also directly connected to the output terminal of the first amplifier at the other input terminal of the differential amplifier for generating the signal representative of the difference based on signals received at the inverting and the non-inverting input terminals;

wherein the integrator is a series circuit consisting of a resistor and a capacitor; and wherein the limiter comprises:

a first diode the anode of which is connected to the junction between the resistor and the capacitor of the integrator and the cathode thereof receiving a predetermined voltage corresponding to the upper value; and a second diode the cathode of which is connected to the junction between the resistor and the capacitor of the integrator and the anode thereof receiving another predetermined voltage corresponding to the lower value.

9. An electronic closed loop air-fuel ratio control system for supplying an optimum air-fuel mixture to an internal combustion engine, which system comprises in combination:

an air-fuel mixture supply assembly;

an exhaust pipe;

an exhaust gas sensor provided in the exhaust pipe for sensing a concentration of a component in exhaust gases, generating a signal representative of said concentration;

a differential signal generator connected to the exhaust gas sensor and receiving the signal from the sensor for generating a signal representative of a difference between magnitudes of the signal from the exhaust gas sensor and a reference signal, the reference signal changing in its magnitude in such a manner as to be substantially equal to a mean-value of the magnitude of the signal from the exhaust gas sensor;

a control signal generator connected to the differential signal generator and receiving the signal from the differential signal generator for generating a control signal based on the received signal;

an actuator provided in the air-fuel mixture supply assembly, connected to the control signal generator, receiving and responsive to the control signal to control the air-fuel ratio of an air-fuel mixture fed to the engine; and a limiter connected to the differential signal generator for limiting at least one of an upper and a lower value of the reference signal;

wherein the differential signal generator comprises:

a first amplifier provided with an input and an output terminal, being connected at the input terminal to the exhaust gas sensor;

an integrator connected to the output terminal of the first amplifier and receiving a signal from the first amplifier to integrate the same, the integrated signal being used as the reference signal, said integrator also being connected to the limiter which limits at least one of the upper and the lower values of the reference signal; and a differential amplifier provided with an inverting and a non-inverting input terminal, being connected to the integrator at one of the input terminals of said differential amplifier and also directly connected to the output terminal of the first amplifier at the other input terminal of the differential amplifier for generating the signal representative of the difference based on signals received at the inverting and the non-inverting input terminals;

wherein the integrator is a series circuit consisting of a resistor and a capacitor; and wherein the differential signal generator further comprises a switching means interposed between the first amplifier and the integrator, and wherein the limiter comprises:

an integrator provided with an input and an output terminal, being connected at its input terminal to the output terminal of the first amplifier, receiving a signal from the first amplifier to integrate the same;

a comparator provided with an inverting and a non-inverting input terminal, being connected at its inverting input terminal to the integrator, receiving the integrated signal from the integrator, also receiving through its non-inverting input terminal a predetermined voltage corresponding to the lower value, generating a signal indicative of a logic "1" when the integrated signal falls below the predetermined voltage;

another comparator provided with an inverting and a non-inverting input terminal, being connected at its non-inverting terminal to the integrator, receiving the integrated signal therefrom, also receiving through its inverting terminal another predetermined voltage corresponding to the upper value, generating a signal indicative of a logic "1" when the integrated signal rises above the another predetermined voltage; and a switching element connected to output terminals of the above mentioned two comparators, responsive to each of the signals therefrom indicating a logic "1" to open the switching means.

* * * * *